US006347205B1

(12) United States Patent
Morganti et al.

(10) Patent No.: US 6,347,205 B1
(45) Date of Patent: Feb. 12, 2002

(54) MOUNTING OF A DRIVE MOTOR IN THE FUSER SECTION OF AN ELECTROPHOTOGRAPHIC MACHINE

(75) Inventors: Terry N. Morganti, Brockport; James V. Orchard, II, Holley, both of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/671,787

(22) Filed: Sep. 27, 2000

(51) Int. Cl.[7] ..... G03G 15/20
(52) U.S. Cl. ..... 399/122
(58) Field of Search ..... 399/122, 107, 399/110, 75, 320; 219/216

(56) References Cited

U.S. PATENT DOCUMENTS 5,835,835 A * 11/1998 Nishikawa et al. ..... 399/122 X

FOREIGN PATENT DOCUMENTS

JP 06-051665 * 2/1994

* cited by examiner

*Primary Examiner*—Sophia S. Chen
(74) *Attorney, Agent, or Firm*—F. Lindsey Scott

(57) ABSTRACT

An electrophotographic apparatus having structure for mounting a drive motor on the fuser section whereby the motor can be removed and replaced from the outside of the housing. The structure includes a mounting structure which is affixed to one of the walls of the housing and an adapter plate which is affixed to the face of the motor. The mounting structure has a stub extension for receiving the gear on the drive motor and a plurality of mounting holes spaced outward therefrom. The adapter plate has a main opening to receive the hub of the motor and openings through which screws secure the plate to the motor. The plate has mounting openings which align with the mounting holes in the mounting structure to secure the plate, hence the motor, to the housing.

12 Claims, 3 Drawing Sheets

MOUNTING OF A DRIVE MOTOR IN THE FUSER SECTION OF AN ELECTROPHOTOGRAPHIC MACHINE

FIELD OF THE INVENTION

The present invention relates to the mounting of a drive motor in the fuser section of an electrophotographic copier/printer apparatus and in one of its aspects relates to an assembly for mounting a drive motor in the fuser section of an electrophotographic apparatus which allows the motor to be removed and replaced from outside the fuser section housing.

BACKGROUND OF THE INVENTION

In a typical electrophotographic machine (e.g. copier, duplicators, printers, etc.), a continuous loop of photoconductor film is commonly used to transfer an image from an input section onto a receiving medium (e.g. a sheet of paper). The film is initially charged and then passes through an input section where an image (i.e. analog or digital) is projected onto the charged film. The film then moves through a developing section where a toner is applied to the charged image, and on through an image transfer section where the image is transferred to the sheet of paper or other medium. The paper is subsequently passed through a fuser section where the toner forming the image is fixed to the paper by elevated temperature and pressure. This is typically accomplished by passing the paper between two, opposed rollers, i.e. a pressure roller and a fuser roller, one of which is heated.

In fuser sections such as described above, it is usual practice to drive only one of the rollers. That is, in several known electrophotographic machines, a drive motor is used to drive the pressure roller which, in turn, drives the fuser roller by frictional contact therewith. As will be fully understood by those skilled in this art, this drive motor may "wear-out" or experience some malfunction from time to time during the operational life of the machine. When this occurs, the motor must be removed and replaced in order to get the machine back up and running.

In known prior art electrophotographic machines of this type, the drive motor for the pressure roller is secured in position on the outside of the housing of fuser section by means of a plurality of bolts or screws which, in turn, have to be installed from inside the fuser housing. These screws extend from the inside of the housing, through openings in said housing, and into mounting holes which are provided in the face of the motor by the manufacturer of the motor. As will be understood in this art, the inside of the fuser housing is severely crowded with rollers and a multitude of other components, making it necessary to remove some of these components in order to access the mounting bolts for the motor.

As will be appreciated by those who depend on such machines in their commercial operations, time is normally of the essence. Therefore, it is imperative that downtime of the machine be kept to a minimum and that all maintenance/service operations be performed in as short of time as possible. Further, to keep maintenance/service costs down, the more frequently required maintenance operations should be capable of being carried out by a single service person with a minimum of special tools, if any. In some cases, if the maintenance/service operations are simple enough, the owner or user of the machine may train an employee to carry out such operations without requiring the services of an contractor.

Accordingly, it is desirable to eliminate the requirement that components be removed and replaced within the fuser housing each time it becomes necessary to remove and/or replace the drive motor for the pressure roller. By doing so, the motor can quickly be removed and replaced by a single technician thereby keeping downtime for the machine to a minimum.

SUMMARY OF THE INVENTION

The present invention provides an electrophotographic apparatus including a means for mounting a drive motor on the outside of the housing of a fuser section whereby the drive motor can be removed and replaced from the outside of the housing without accessing the inside of the housing. This eliminates the need for a technician to remove and then replace any of the components within the fuser section housing during the removal and replacement of the drive motor.

More specifically, the means for mounting the drive motor on the fuser section housing is comprised of a mounting structure affixed to one of the walls of the housing and an adapter plate which is affixed to the face of a standard, commercially-available drive motor. The mounting structure is comprised of a stub extension and a plurality of mounting holes spaced outward therefrom. The stub extension has a central bore for receiving (a) the gear on the drive motor which meshes with the gear on the pressure roller in the fuser housing and (b) a portion of hub of the drive motor. The central bore is stepped to provide a shoulder which supports the hub of the drive motor when the motor is in an operable position within the central bore thereby properly positioning the gear on the drive motor in relation to the gear on the pressure roller. Preferably, the mounting structure is cast as an integral part of the housing wall.

The adapter plate has a main opening therein through which the hub of the motor extends and to a short distance beyond. It is this short portion of the hub that is received into the central bore of the mounting structure when the adapter plate is positioned on the mounting structure. A plurality of openings surround the main opening and positioned to align with the threaded holes in the face of the drive motor which are provided therein by the motor's manufacturer. The adapter plate is secured to the face of the drive motor by means of threaded members (e.g. screws) through the aligned openings and holes.

The adapter plate has a plurality of mounting openings near its outer periphery which align with the threaded holes in the mounting structure. Threaded members (e.g. bolts) pass through the mounting openings and into the threaded holes to secure the drive motor onto the housing of the fuser section. It can be seen that by securing the drive motor to the fuser housing with bolts that are readily accessible from outside the housing, removal and replacement of the drive motor is significantly simplified resulting in shorter downtimes and less effort required of the technician.

BRIEF DESCRIPTION OF THE DRAWINGS

The actual construction operation, and apparent advantages of the present invention will be better understood by referring to the drawings, not necessarily to scale, in which like numerals identify like parts and in which.

DESCRIPTION OF THE PREFERRED EMBODIMENTS

Figure 1:
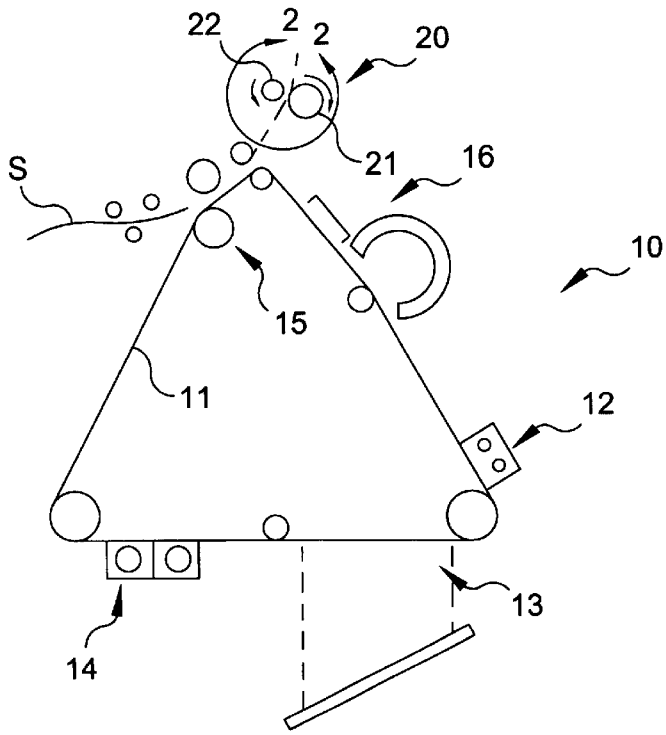
FIG. 1 is a schematic view of an electrophotographic apparatus (e.g. copier/printer machine) in which the present invention can be incorporated.

Referring briefly to FIG. 1, a typical electrophotographic apparatus or machine 10 (e.g. copier, duplicator, printer) of the kind that has an endless photoconductor member 11 (e.g. photographic film) which moves through a closed loop past a charging station 12, a an exposure or input station 13, a developing station 14, a transfer station 14, and an erase/clean section 16. A copy medium (e.g. a sheet S of paper) is fed from a supply (not shown) through transfer station 15 where the toner image on the film 11 is transferred to the paper S. The paper S is then fed between a fusing roller 21 and a pressure roller 22 in fuser section 20 to fix the toner image on the paper S before the paper exits the machine.

Figure 2:
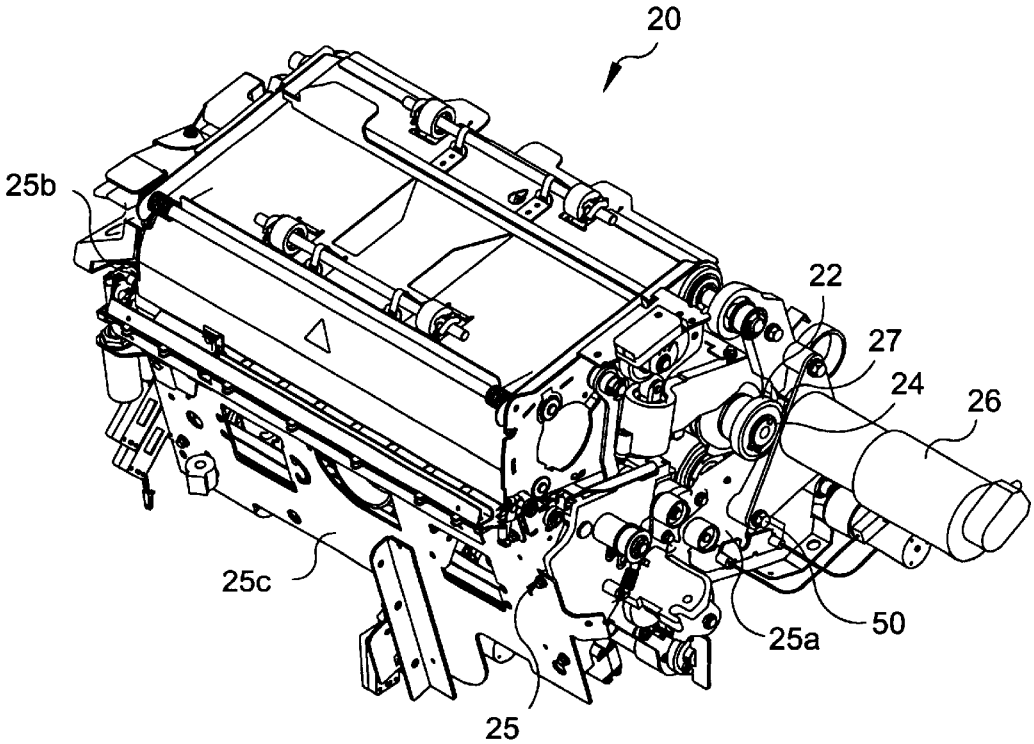
FIG. 2 is a perspective view of the fuser section lying within line 2—2 of FIG. 1 with the present invention incorporated thereon.
Figure 3:
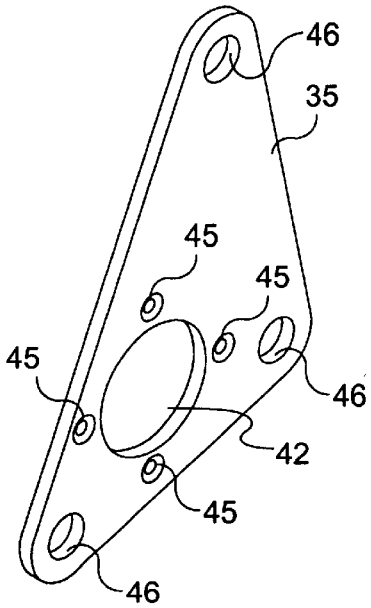
FIG. 3 is a perspective view of the adapter plate of the present invention.
Figure 4:
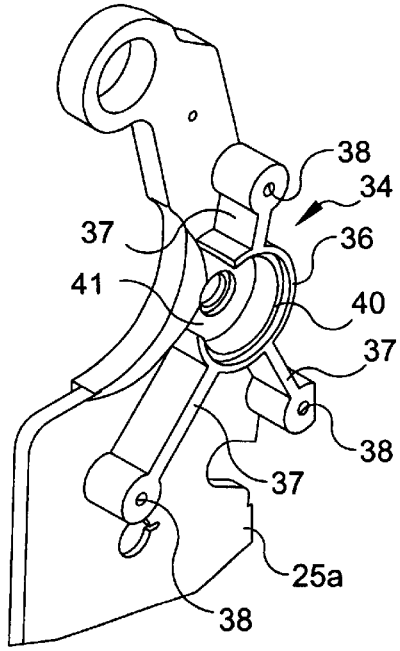
FIG. 4 is a perspective view, partly broken away, of the fuser section housing including the drive motor mounting structure of the present invention.
Figure 5:
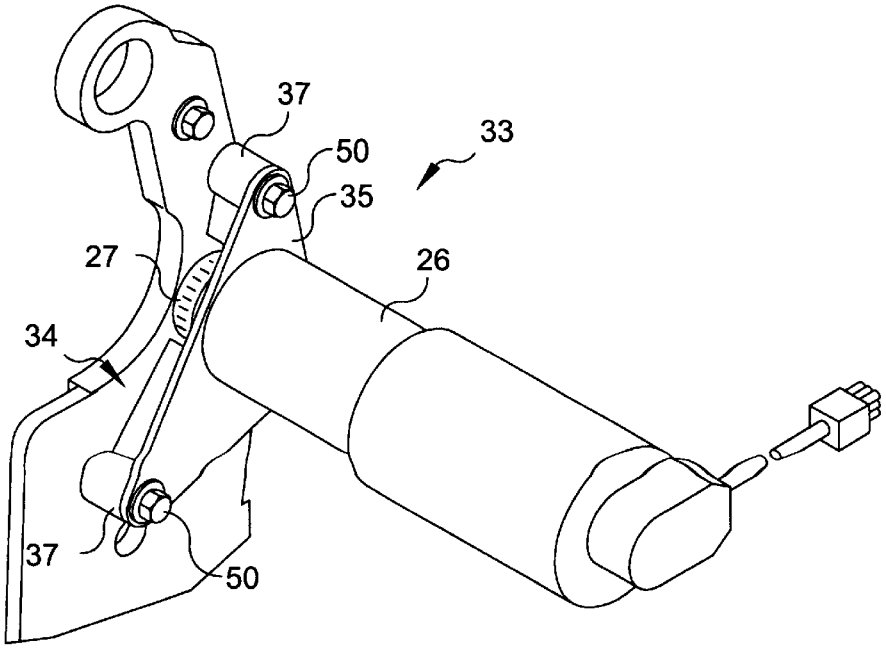
FIG. 5 is a perspective view, partly broken-away, of a standard drive motor including the adapter plate of FIG. 3 mounted on the fuser section housing of FIG. 4.

FIG. 2 is a perspective view of a typical fuser section 20 which might be found in the electrophotographic machine 10 of FIG. 1. As illustrated, fuser section 20 is comprised of a frame or housing 25 in which pressure roller 22 and fuser roller are rotatably mounted. Housing 25, as illustrated, is comprised of a rear casing 25*a* and a front casting 25*b* and plating 25*c* or the like which connect the two castings. As will be appreciated, housing 25 is filled with other rollers and a sophisticated maze of electrical and mechanical components (unnumbered) which crowd and congest the inside of housing 25.

A commercially-available, drive motor 26 is mounted on the outside of housing 25 and has a gear 27 on its output shaft which meshes with a gear 24 on pressure roller 22 to rotate pressure roller 22. Pressure roller 22 then drives (i.e. rotates) fuser roller 21 (FIG. 1) through the frictional contact therebetween, as will be understood in this art.

Figure 6:
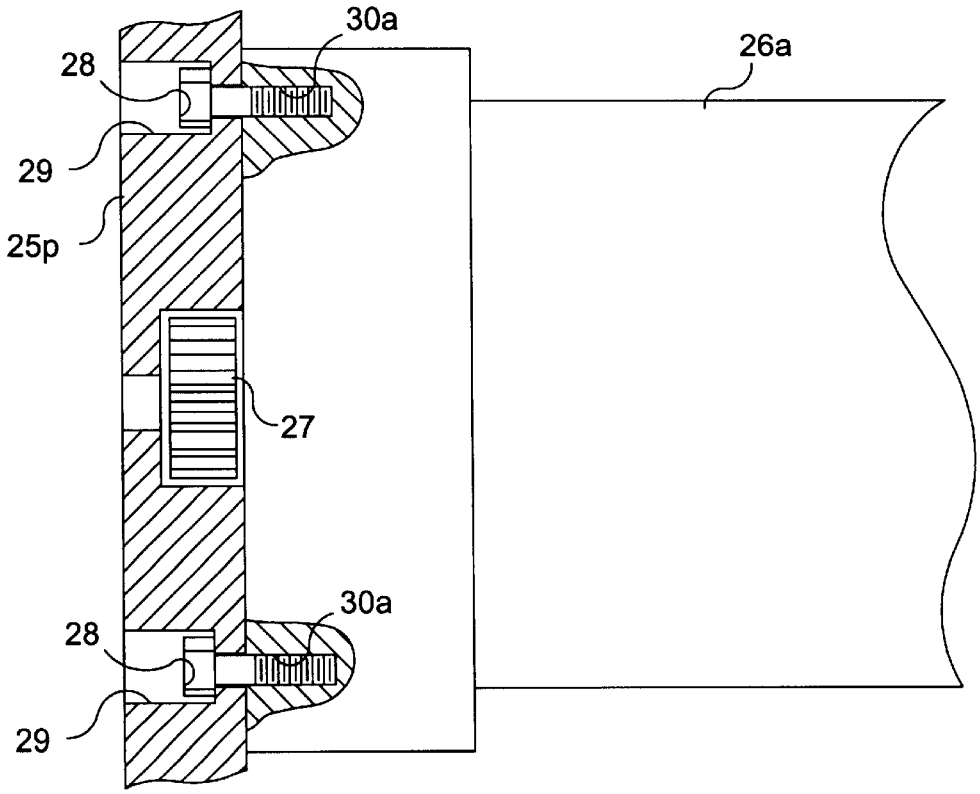
FIG. 6 (PRIOR ART)
FIG. 6 is a broken-away view, partly in section, showing how a drive motor is typically mounted on a prior art fuser section.
Figure 7:
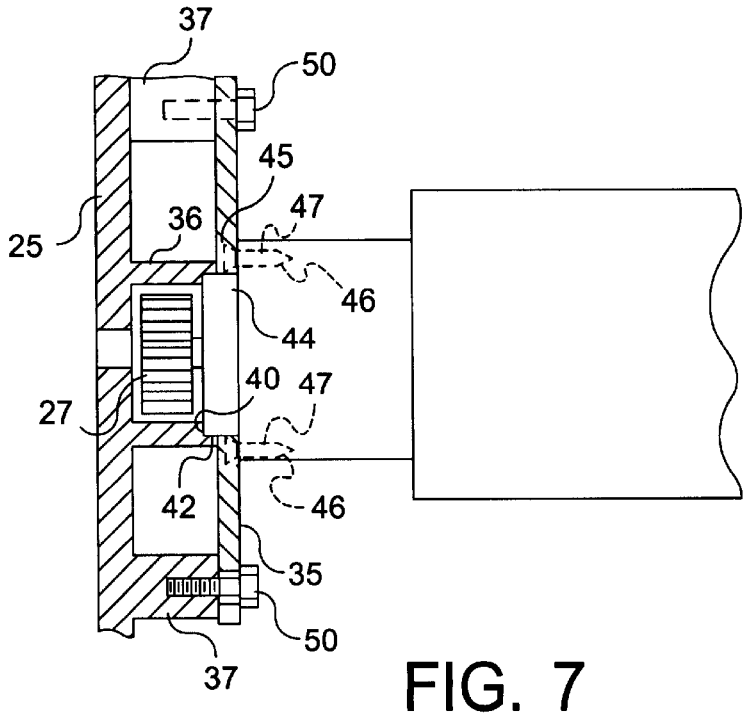
FIG. 7 is a broken-away view, partly in section, showing how a drive motor is mounted on the housing of a fuser section in accordance with the present invention.

In prior art machines of this type, drive motor 26*a* (FIG. 6) is typically secured in position on the wall of fuser housing (i.e. rear casting 25*p*) by a plurality (e.g. four) of bolts or screws 28 which pass through openings 29 in housing 25*p* and into mounting holes 30*a* which are provided on the face of motor 26*a* by the manufacturer. As can be seen, screws 28 have to be installed from inside housing 25*a* which, unfortunately, requires a technician to remove certain components from inside the housing in order to get access to the screws. Of course, these components have to be replaced when the installation of the motor 26*a* has been completed. This is time consuming and can result in other problems if the technician is not experienced.

The mounting assembly of the present invention alleviates these problems and reduces both the time and the effort involved in replacing a drive motor for the pressure roller in fuser section 20. Referring now to FIGS. 2–5 and 7, the mounting assembly 33 of the present invention is comprised of (a) a mounting structure 34 which is affixed to the outside of the wall of fuser housing 25 (e.g. rear casting 25*a*) and (b) an adapter plate 35 which is adapted to be connected to the face of a commercially-available drive motor 26. Preferably, mounting structure 34 is cast as an integral part of the rear casting 25*a* and is comprised of a cylindrical, stub-like extension 36 which has a plurality (e.g. three) of substantially equally, radially-spaced arms 37 extending outward therefrom. Each arm 37 has a threaded, mounting hole 38 at the outer end thereof. Stub 36 has a stepped central bore therethrough having a shoulder 40 (FIGS. 4 and 7) therein for a purpose to be explained below. Also, a portion 41 of the wall of the stub extension 36 is missing to allow gear 27 on motor 26 to mesh with gear 24 (FIG. 1) on pressure roller 22 when motor 26 is in an operable position on fuser housing 25.

Adapter plate 35, as shown, is a triangular shaped plate having a main opening 42 therethrough which is adapted to receive the hub 44 (FIG. 7) of motor 26. It should be recognized that plate 35 could have different shaped perimeters without departing from the present invention. A plurality of counter-sunk openings 45 surround main opening 42 and are arranged and sized to align with threaded openings 46 (FIG. 7) which are provided in the face of a standard, commercially-available drive motor by its manufacturer. Openings 45 may be oversized to allow some tolerance in aligning the openings with the holes in the motor. A mounting opening 46 is provided through plate 35 near each of the three corners thereof and are adapted to align respectively with the threaded mounting holes 38 in mounting structure 34 when plate 35 is in an operable position on the mounting structure and is secured thereto by bolts 50 or the like.

In operation, when motor 26 needs to be serviced or replaced, it is a simple procedure to merely remove the old motor by removing the bolts 50 which can easily be done from outside fuser section housing 25, thereby eliminating the need to remove any components from within the housing. Next, the new or refurbished motor 26 can be just as easily installed. First, adapter plate 35 is assembled onto the new motor by passing the hub 44 of motor 26 through main opening 42 in the adapter plate. Hub 44 will extend all the way through opening 42 and for a short distance beyond when plate 35 is properly positioned on the motor. Plate 35 is then secured to the face of motor 26 by threaded members, e.g. screws 47 (FIG. 7), which pass through opening 45 in plate 35 and into threaded holes 46 in the face of motor 26.

Motor 26 with adapter plate 35 affixed thereto is now positioned onto the mounting structure 34 on the rear casing 25*a* of fuser housing 25. The portion of hub 44 which extends beyond plate 35 is positioned within the bore of stub 36 so that the end of the hub abuts against and is supported by the shoulder 40 therein. This insures that the motor, hence gear 27 will be properly aligned with gear 24 on the pressure roller 22 when the motor is secured in its operable position. Mounting openings 46 are aligned with threaded mounting holes 38 in the mounting structure 34 and plate is secured to structure 34 by threaded members, e.g. bolts 50 or the like. Again, this replacement of drive motor 26 can easily and quickly be carried out by a single technician without ever disturbing the components within the fuser section housing.

What is claimed is:

1. An electrophotographic apparatus having a fuser section, said fuser section comprising:

a housing;

a roller mounted in said housing;

a gear on said roller;

a drive motor having a gear which is adapted to mesh with said gear on said roller to drive said roller when said drive motor is in an operable position on said housing; and structure on said motor and said housing for mounting said drive motor onto the outside of said housing whereby said drive motor can be removed and replaced from the outside of said housing without accessing the inside of said housing.

2. The electrophotographic apparatus of claim 1 wherein said housing comprises:

a plurality of walls, and wherein said structure for mounting said drive motor comprises:

a mounting structure affixed to one of said plurality of walls of said housing; said mounting structure having a plurality of mounting holes spaced on; and an adapter plate having openings therethrough aligned with threaded holes in the face of said drive motor;

first threaded members passing through said openings in said adapter plate and into said threaded holes in said drive motor to secure said adapter plate to said drive motor;

said adapter plate having mounting openings therethrough aligned with said mounting holes in said mounting structure; and second threaded members passing through said mounting openings in said adapter plate and into said mounting holes in said mounting structure to secure said drive motor to said housing.

3. The electrophotographic apparatus of claim 2 wherein said drive motor has a hub extending from said face of said motor, and wherein said adapter plate has a main opening adapted to receive said hub of said motor whereby said hub extends through said main opening and a short distance beyond; and wherein said mounting structure comprises:

a stub extension affixed to said one wall of said housing, said stub extension having a central bore therethrough and adapted to receive said gear on said drive motor and that portion of said hub of said drive motor which extends beyond said adapter plate; and wherein said mounting holes in said mounting structure are spaced outwardly from said stub extension.

4. The electrophotographic apparatus of claim 3 wherein said central bore of said stub extension has a shoulder therein, said shoulder adapted to support said hub of said drive motor to thereby properly position said gear on said drive motor within said central bore when said drive motor is in an operable position within said central bore.

5. The electrophotographic apparatus of claim 3 wherein said one wall of said housing is a casting and wherein said mounting structure is cast as an integral part thereof.

6. The electrophotographic apparatus of claim 3 wherein said adapter plate is triangular in shape and wherein said mounting openings are positioned near the corners of said adapter plate.

7. An electrophotographic apparatus having a fuser section, said fuser section comprising:

a housing;

a roller mounted in said housing;

a gear on said roller;

a drive motor having a gear which is adapted to mesh with said gear on said roller to drive said roller when said drive motor is in an operable position on said housing; and means for mounting said drive motor onto the outside of said housing whereby said drive motor can be removed and replaced from the outside of said housing without accessing the inside of said housing.

8. The electrophotographic apparatus of claim 7 wherein said housing comprises:

a plurality of walls, and wherein said means for mounting said drive motor comprises:

a mounting structure affixed to one of said plurality of walls of said housing; said mounting structure having a plurality of mounting holes spaced on; and an adapter plate having openings therethrough aligned with threaded holes in the face of said drive motor;

first threaded members passing through said openings in said adapter plate and into said threaded holes in said drive motor to secure said adapter plate to said drive motor;

said adapter plate having mounting openings therethrough aligned with said mounting holes in said mounting structure; and second threaded members passing through said mounting openings in said adapter plate and into said mounting holes in said mounting structure to secure said drive motor to said housing.

9. The electrophotographic apparatus of claim 8 wherein said drive motor has a hub extending from said face of said motor, and wherein said adapter plate has a main opening adapted to receive said hub of said motor whereby said hub extends through said main opening and a short distance beyond; and wherein said mounting structure comprises:

a stub extension affixed to said one wall of said housing, said stub extension having a central bore therethrough and adapted to receive said gear on said drive motor and that portion of said hub of said drive motor which extends beyond said adapter plate; and wherein said mounting holes in said mounting structure are spaced outwardly from said stub extension.

10. The electrophotographic apparatus of claim 9 wherein said central bore of said stub extension has a shoulder therein, said shoulder adapted to support said hub of said drive motor to thereby properly position said gear on said drive motor within said central bore when said drive motor is in an operable position within said central bore.

11. The electrophotographic apparatus of claim 9 wherein said one wall of said housing is a casting and wherein said mounting structure is cast as an integral part thereof.

12. The electrophotographic apparatus of claim 9 wherein said adapter plate is triangular in shape and wherein said mounting openings are positioned near the corners of said adapter plate.

* * * * *